US008915793B2

(12) United States Patent
Hou

(10) Patent No.: US 8,915,793 B2
(45) **Date of Patent: *Dec. 23, 2014**

(54) GOLF CLUB SWING TRAINING APPARATUS

(71) Applicant: Wen-Sun Hou, Westlake Village, CA (US)

(72) Inventor: Wen-Sun Hou, Westlake Village, CA (US)

( * ) Notice: Subject to any disclaimer, the term of this patent is extended or adjusted under 35 U.S.C. 154(b) by 77 days.

This patent is subject to a terminal disclaimer.

(21) Appl. No.: 13/783,034

(22) Filed: Mar. 1, 2013

(65) Prior Publication Data

US 2014/0248969 A1 Sep. 4, 2014

(51) Int. Cl.
*A63B 59/00* (2006.01)
*A63B 69/36* (2006.01)

(52) U.S. Cl.
CPC ..... *A63B 69/3623* (2013.01)
USPC ..... 473/232; 473/234; 473/316; 473/409

(58) Field of Classification Search
USPC ..... 473/232–234, 226, 294, 296, 316, 324, 473/409, 219, 239, 422
See application file for complete search history.

(56) References Cited

U.S. PATENT DOCUMENTS

| | | | | | |
|---|---|---|---|---|---|
| 695,579 | A | * | 3/1902 | Parmele | 473/311 |
| 1,428,015 | A | * | 9/1922 | Dienner | 473/232 |
| 1,529,305 | A | * | 3/1925 | Gatke | 473/232 |
| 3,180,308 | A | * | 4/1965 | Carroli et al. | 73/849 |
| 3,341,203 | A | * | 9/1967 | Brill | 473/298 |
| 3,953,035 | A | | 4/1976 | Beckisk | |
| 4,027,886 | A | | 6/1977 | Katsube | |
| 4,145,054 | A | | 3/1979 | Stewart | |
| 4,576,378 | A | | 3/1986 | Backus | |
| 4,614,343 | A | | 9/1986 | Radway | |
| 4,854,585 | A | | 8/1989 | Koch et al. | |
| 4,932,661 | A | | 6/1990 | Choi | |
| 4,969,921 | A | * | 11/1990 | Silvera | 473/234 |
| 5,026,064 | A | | 6/1991 | Novosel | |
| 5,037,103 | A | * | 8/1991 | Williams et al. | 473/294 |
| 5,082,283 | A | * | 1/1992 | Conley et al. | 473/234 |
| 5,143,376 | A | | 9/1992 | Johnson | |
| 5,195,748 | A | | 3/1993 | Koch et al. | |
| 5,226,652 | A | * | 7/1993 | Sato | 473/312 |
| 5,277,427 | A | * | 1/1994 | Bryan et al. | 473/232 |
| 5,372,557 | A | * | 12/1994 | Ostigny | 482/49 |
| 5,415,406 | A | | 5/1995 | Reichenbach et al. | |
| 5,467,993 | A | | 11/1995 | Higginson | |
| 5,527,039 | A | | 6/1996 | Levesque | |
| 5,580,321 | A | | 12/1996 | Rennhack | |
| 5,588,920 | A | | 12/1996 | Soong | |
| 5,616,087 | A | * | 4/1997 | Bothwell | 473/316 |
| 5,700,205 | A | | 12/1997 | Sanford | |
| 5,735,752 | A | * | 4/1998 | Antonious | 473/317 |

(Continued)

*Primary Examiner* — Sebastiano Passaniti
(74) *Attorney, Agent, or Firm* — Lyon & Harr, LLP; Richard T. Lyon

(57) ABSTRACT

A golf club swing training apparatus designed to help golfers learn to selectively control a golf ball trajectory shape so that the ball is made to "bend" from right to left, or left to right. The apparatus is configured as an otherwise conventional golf club such as a driver, but wherein the shaft is spliced at a location along its length between the butt end and the head end. After removing a short piece of shaft to retain the overall length of the club, a slide mechanism is inserted to mate with the shaft's upper and lower portions. The slide mechanism permits limited transverse movement of the lower portion that is connected to the golf club head relative to the upper portion that includes the butt end or grip of the club.

9 Claims, 4 Drawing Sheets

(56) References Cited

U.S. PATENT DOCUMENTS

| | | | | |
|---|---|---|---|---|
| 5,860,871 | A | 1/1999 | Marley, Jr. | |
| 5,941,779 | A | 8/1999 | Zeiner-Gundersen | |
| 6,012,988 | A | 1/2000 | Burke | |
| 6,059,668 | A | 5/2000 | Marley, Jr. | |
| 6,071,199 | A * | 6/2000 | Suzuki | 473/294 |
| 6,257,992 | B1 * | 7/2001 | LeBlanc | 473/316 |
| 6,358,157 | B1 | 3/2002 | Sorenson | |
| 6,440,005 | B1 | 8/2002 | Hubenig | |
| 6,881,156 | B1 | 4/2005 | Phillips | |
| 7,018,302 | B2 * | 3/2006 | Jacoby | 473/294 |
| 7,041,000 | B1 | 5/2006 | Galloway | |
| 7,074,133 | B1 | 7/2006 | Jones et al. | |
| 7,285,055 | B2 | 10/2007 | Radle | |
| 7,416,492 | B2 * | 8/2008 | Wesley | 473/226 |
| 7,455,595 | B1 | 11/2008 | Gibbons et al. | |
| 8,348,779 | B2 | 1/2013 | Kim | |
| 2006/0122000 | A1 | 6/2006 | Paredes et al. | |
| 2007/0275788 | A1 | 11/2007 | Delpine | |
| 2010/0167830 | A1 | 7/2010 | Hinton et al. | |
| 2012/0064986 | A1 | 3/2012 | Brooks | |
| 2013/0267340 | A1 | 10/2013 | Wolf | |

* cited by examiner

GOLF CLUB SWING TRAINING APPARATUS

BACKGROUND OF THE INVENTION

1. Field of the Invention

The present invention relates generally to the field of golf clubs and more particularly to a golf club training device for improving a golfer's swing. In a disclosed embodiment, a golf club shaft is cut transversely along its length, a portion is removed, and an offset slide mechanism is inserted at the cut to enable a lower portion of the shaft to move transversely relative to an upper portion of the shaft during a desired swing. The natural flexibility of a golf club shaft is employed to shape a properly hit golf ball trajectory to selectively curve the ball, either left to right, or right to left. The training device hereof teaches a golfer to swing a golf club in a manner that exploits the momentum of the golf club head to achieve the desired ball trajectory shape.

2. Background Art

Golfers are always looking for ways to improve their scores. As a result, many different kinds of training devices have been disclosed in issued U.S. patents for improving various aspects of a golfer's skills. Some such training devices are specifically configured to improve a golfer's swing so that he or she hits a golf ball longer or straighter or more accurately. Normally, such training devices are designed to be used at a hitting range where repeated use of the device will produce muscle memory or other physical effect to alter the golfer's swing for the better using conventional golf clubs during an actual round of golf. The present invention is such a device. Examples of prior art golf club training devices are found in disclosures of the following issued patents and pending patent applications.

| | |
|---|---|
| U.S. Pat. No. 3,953,035 | Beckisk |
| U.S. Pat. No. 4,027,886 | Katsube |
| U.S. Pat. No. 4,145,054 | Stewart |
| U.S. Pat. No. 4,576,378 | Backus |
| U.S. Pat. No. 4,614,343 | Radway |
| U.S. Pat. No. 4,854,585 | Koch et al |
| U.S. Pat. No. 4,932,661 | Choi |
| U.S. Pat. No. 5,026,064 | Novosel |
| U.S. Pat. No. 5,143,376 | Johnson |
| U.S. Pat. No. 5,415,406 | Reichenbach et al |
| U.S. Pat. No. 5,467,993 | Higginson |
| U.S. Pat. No. 5,527,039 | Levesque |
| U.S. Pat. No. 5,580,321 | Rennhack |
| U.S. Pat. No. 5,700,205 | Sanford |
| U.S. Pat. No. 5,860,871 | Marley, Jr. |
| U.S. Pat. No. 5,941,779 | Zeiner-Gundersen |
| U.S. Pat. No. 6,012,988 | Burke |
| U.S. Pat. No. 6,059,668 | Marley, Jr. |
| U.S. Pat. No. 6,358,157 | Sorenson |
| U.S. Pat. No. 6,440,005 | Hubenig |
| U.S. Pat. No. 6,881,156 | Phillips |
| U.S. Pat. No. 7,041,000 | Galloway |
| U.S. Pat. No. 7,285,055 | Radle |
| U.S. Pat. No. 7,455,595 | Gibbons et al |
| U.S. Pat. application No. 2006/0,122,000 | Paredes et al |
| U.S. Pat. application No. 2007/0,275,788 | Delpine |
| U.S. Pat. application No. 2010/0,167,830 | Hinton et al |
| U.S. Pat. application No. 2012/0,064,986 | Brooks |

None of the aforementioned prior art relates to a training device specifically configured to improve a golfer's ability to selectively shape the ball's trajectory so that the ball moves right to left or left to right in a controlled manner. Moreover, none of the prior art listed herein, or otherwise known to the Applicant, employs a swing training club wherein a device is actually inserted in between upper and lower portions of a cut shaft so that one such portion can be moved laterally relative to the other such portion by forces incurred during a preferred swing.

SUMMARY OF THE INVENTION

The present invention comprises a golf club swing training apparatus designed to help golfers learn to selectively control a golf ball trajectory shape so that the ball is made to "bend" from right to left, or left to right. The apparatus is configured as an otherwise conventional golf club such as a driver, but wherein the shaft is spliced at a location along its length between the butt end and the head end. After removing a short piece of shaft to retain the overall length of the club, a slide mechanism is inserted to mate with the shaft's upper and lower portions. The slide mechanism permits limited transverse movement of the lower portion that is connected to the golf club head relative to the upper portion that includes the butt end or grip of the club. This motion is substantially in a direction that is orthogonal to the elongated axis of the shaft and in the preferred embodiment hereof, is limited to a maximum travel of about 0.25 inches. The motion will occur during successful use of the training device, that is, during a proper swing for achieving the desired control of ball trajectory shape. The desired motion of the slide mechanism is normally heard and felt by the golfer during the swing so that he or she has both audible and tactile feedback through the golf club training device indicating that a desired swing profile has been achieved.

BRIEF DESCRIPTION OF THE DRAWINGS

The aforementioned objects and advantages of the present invention, as well as additional objects and advantages thereof, will be more fully understood herein after as a result of a detailed description of a preferred embodiment when taken in conjunction with the following drawings in which.

DETAILED DESCRIPTION OF A PREFERRED EMBODIMENT

Figure 1:
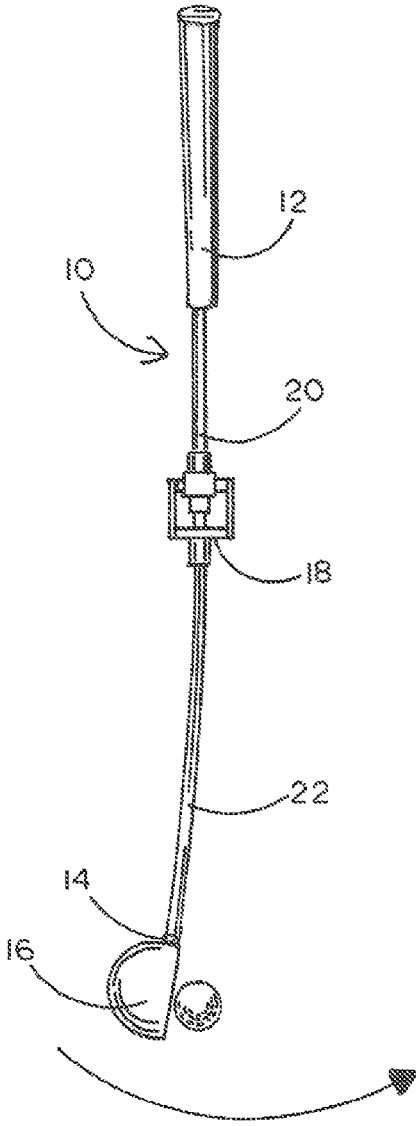
FIGS. 1 and 2 illustrate the general shape of the training golf club hereof at impact with a golf ball under two distinct conditions providing two alternative trajectories, one for left to right curvature and the other for right to left curvature.

Turning to the accompanying drawings, it will be seen in FIG. 1 that the present invention comprises a golf club 10 which has a shaft 12 connected by a hosel 14 to a head 16. However, unlike any other golf club, the invention employs a slide mechanism 18 which has been interposed into the shaft 12 between an upper portion 20 and a lower portion 22 so that mechanism 18 interconnects those two portions 20 and 22. In the particular embodiment shown in FIG. 1 the golf club 10 comprises a driver club and the slide mechanism 18 has been interposed about two-fifths down the length of the club including the head 16. So for example, in a driver having an overall length of 45 inches, the slide mechanism 18 would be at about 18 inches from the butt end of the shaft 12. The shaft would typically be cut through at that location in a direction that is substantially perpendicular to the axis of the shaft. The slide mechanism is then connected in between the resulting upper and lower portions of the shaft after removing a short piece of shaft from the lower portion to accommodate the approximate two inch length of the slide mechanism to retain the overall length of the club. The location of the shaft splice is preferably selected to be at or near the maximum bend point or apex of the shaft which may vary with the length and type of golf club. Therefore, in a shorter club such as a 3-wood or 2-iron, the splice point might be somewhat closer to the butt end.

Figure 2:
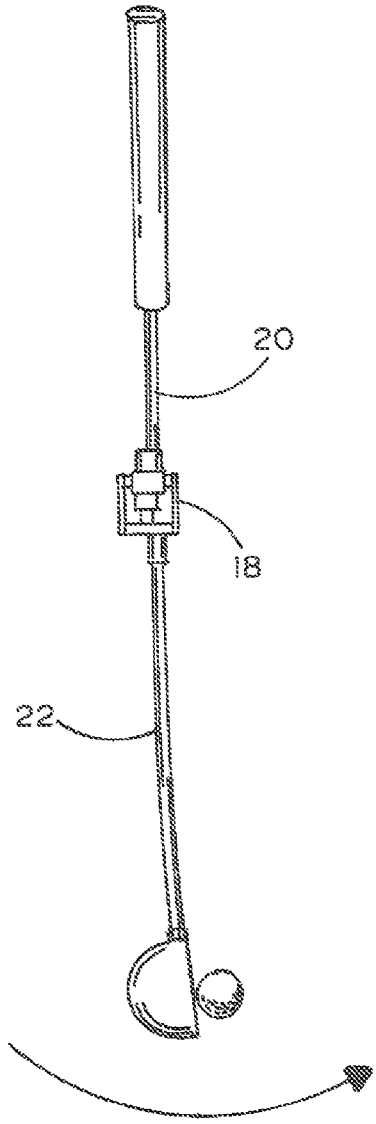
Figure 3:
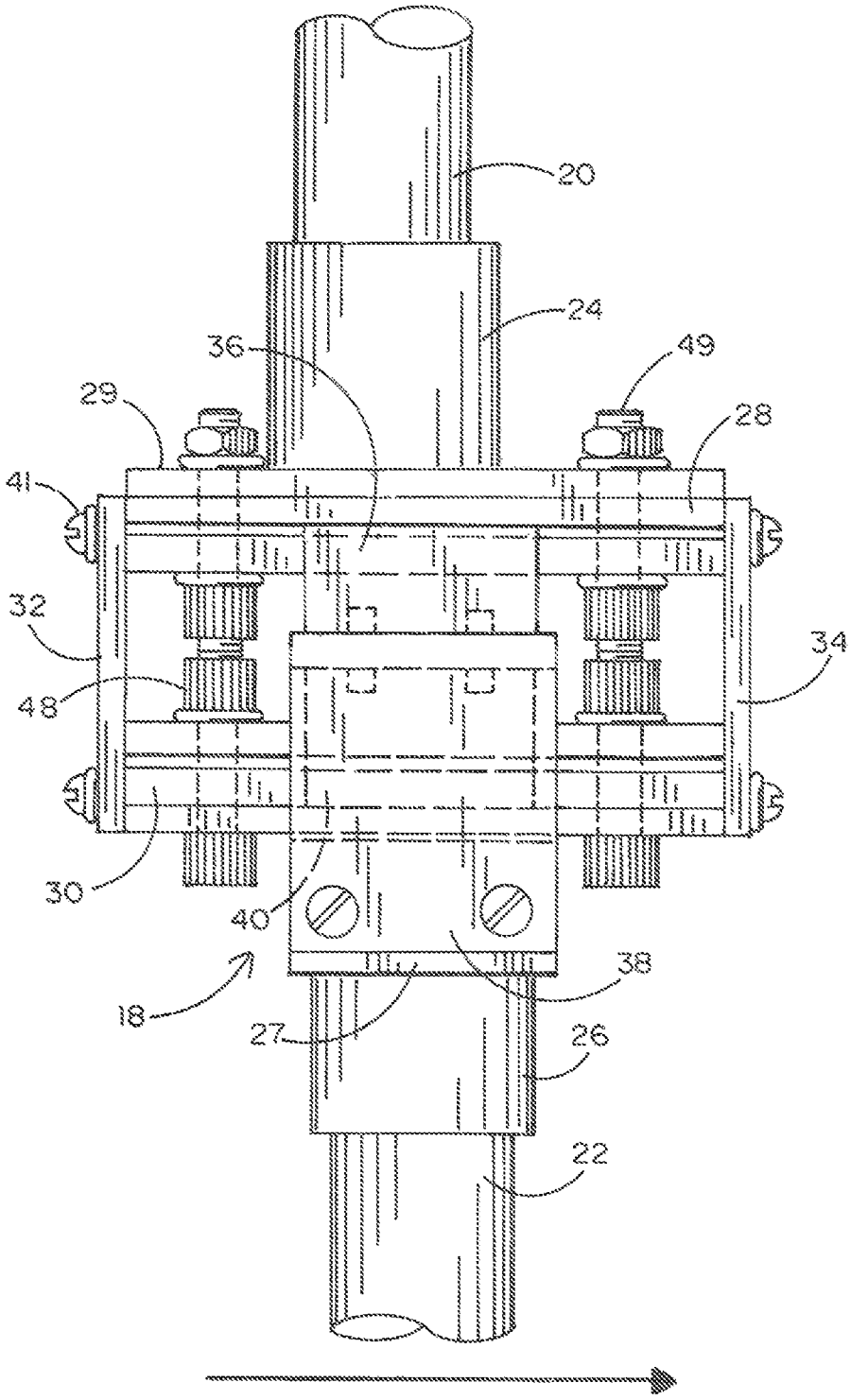
FIG. 3 is a plan view of a slide mechanism shown inserted into a golf club shaft according to the embodiment of FIG. 1.

Slide mechanism 18 is best understood by referring to FIGS. 3-7. As shown in FIG. 3, when fully assembled and connected, slide mechanism 18 permits low friction lateral movement of lower shaft portion 22 relative to upper shaft portion 20. Connectors 24 and 26 are adhesively connected to respective shaft portions 20 and 22 so that the longitudinal axis of both the upper shaft portion and the lower shaft portion may be axially aligned to be perfectly co-axial. However, depending upon the forces incurred during a full swing such as to impact a tee-supported golf ball, lower shaft portion 22 may slide or shift transversely to up to about 0.25 inches to produce a non-intersecting off-axis position to advance the head toward the ball at impact. Such shift will result in a right to left trajectory profile when the head face is square at ball impact. On the other hand, when the golfer controls his or her swing to prevent such a shift of lower portion 22, the two portions remain substantially co-axial, and the head impacts the ball behind the shaft axis resulting in a left to right trajectory shape with a square face at impact. These two distinct conditions are shown in FIGS. 1 and 2.

Figure 4:
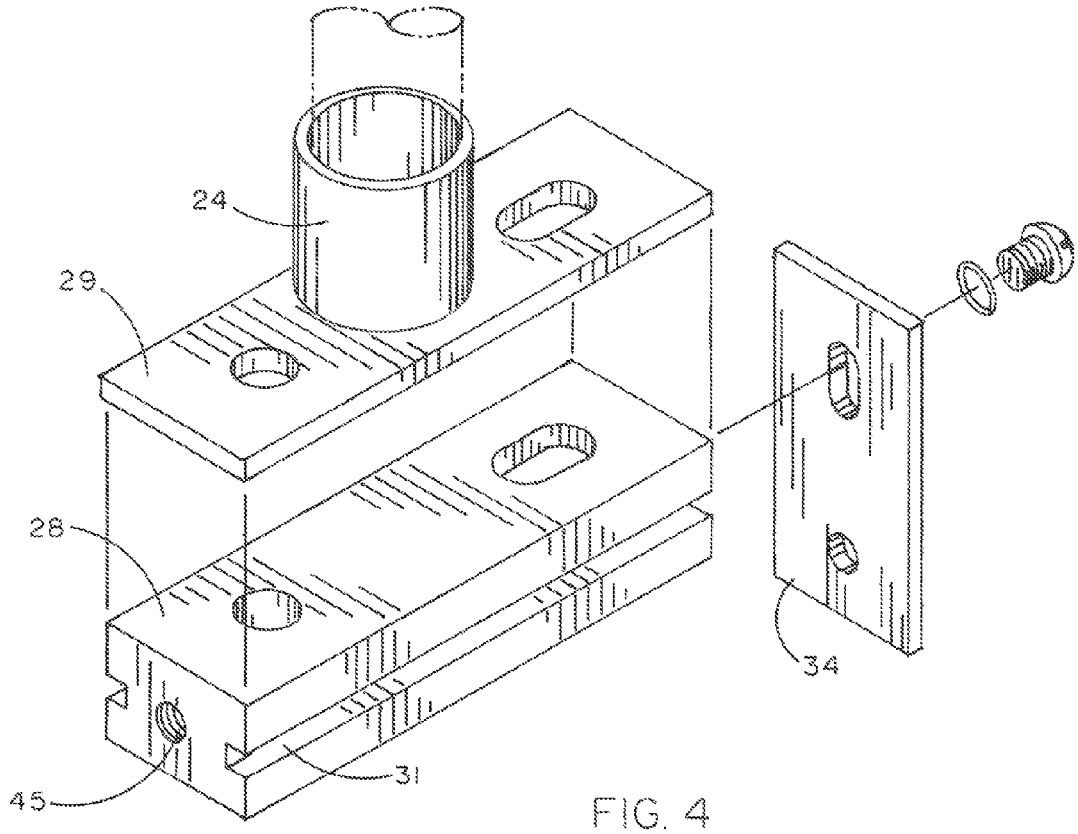
FIGS. 4 through 7 are three-dimensional drawings of various components of the slide mechanism of FIG. 3.
Figure 5:
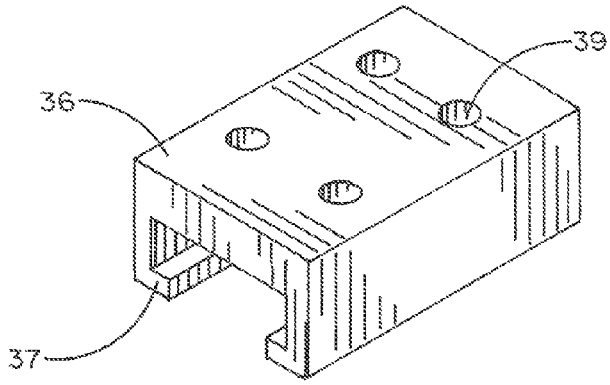
Figure 6:
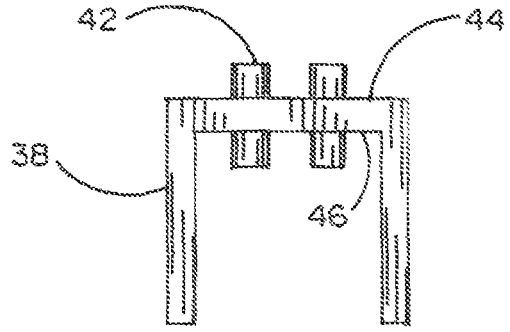
Figure 7:
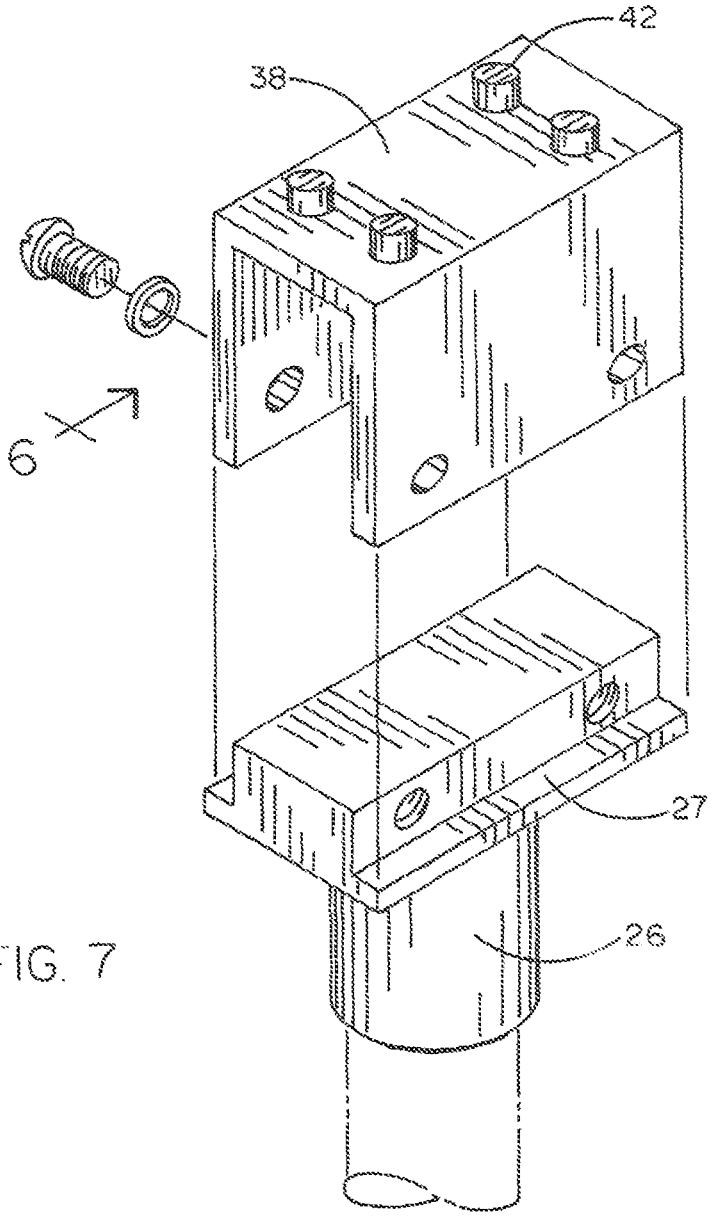

Returning to FIGS. 3-7, it is seen that the disclosed slide embodiment 18 further comprises an interface 27, slide rails 28 and 30, rail interface plate 29, rail stabilizers 32 and 34, linear guide blocks 36 and 40 and a yoke 38. As shown in FIG. 4, each slide rail 28 and 30 has an elongated rail slot 31 which receives a rail travel flange 37 (see FIG. 5) in sliding engagement. Yoke 38, seen in FIGS. 6 and 7, provides a plurality of vertical, cylindrical probes 42 on opposing surfaces 44 and 46. These probes 42 permit a stable mechanical interface with linear guide blocks 36 and 40 by mating with aligned block holes 39 shown in FIG. 5. Upper linear guide block 36 has its holes directed down and lower linear guide block 40 has its holes directed up as viewed in FIG. 3 so that they each mate in opposing directions with yoke 38 and thus slide together as one unit along parallel and space apart rails 28 and 30. Further, the distance between glide rail 28 and 30 is adjustable using nobs 48 and set with fasteners 49 that compresses the slide rails toward one another with the yoke 38 therebetween. This dual rail assembly provides strong mechanical resistance to bending and possible breakage during the swing with even the highest likely club head speed. Finally, mechanical strength and uniform slide motion is assured by virtue of the rail stabilizers 32 and 34 which are bolted by screws 41 into respective threaded apertures 45 at the respective ends of the slide rails as shown in FIG. 4. The completely assembled slide mechanism 18 permits limited sliding of the lower shaft portion 22 relative to the upper shaft portion 20 over a selected short distance (i.e., ≤0.25 inches) with substantial mechanical integrity.

It will now be understood that by practicing with the swing training club of the present invention, a golfer will learn how to control and alter the swing to produce a desired ball trajectory profile of either right to left or left to right. Moreover, it will be appreciated that the slide mechanism herein may produce a sudden shift of the lower portion of the shaft which generates both a sound and a tactile impact to let the golfer know whether and when such a shift or slide has occurred during the swing and to change swing mechanics to either produce a shift or prevent a shift as desired for a selected trajectory.

Although a particular embodiment has been disclosed herein, those having skill in the art of golf clubs and mechanical interconnect devices will perceive various alternative embodiments which may be utilized to achieve the same function and results. Therefore, the scope hereof will not be deemed to be limited by the exemplary embodiment hereof, but instead only by the appended claims.

What is claimed is:

1. A golf club swing training apparatus comprising:

a golf club shaft having a butt end and a head end, said shaft having two separate and distinct portions spaced apart to form a gap therebetween, said portions comprising an upper shaft portion comprising said butt end of said shaft and a lower shaft portion comprising said head end of said shaft;

a ball striking head affixed to said head end of said shaft;

a slide mechanism positioned within said gap and attached to the lower end of said upper shaft portion and the upper end of said lower shaft portion;

said slide mechanism configured to permit a lateral shift of said upper end relative to said lower end during a swinging of said club, said lateral shift resulting in a non-intersecting offset between the longitudinal axis of said upper end and the longitudinal axis of said lower end.

2. The golf club swing training apparatus recited in claim 1 wherein said lateral shift is over a distance not exceeding a quarter inch.

3. The golf club swing training apparatus recited in claim 1 wherein the shaft portion connected to said head end of said shaft is longer than the shaft portion connected to said butt end of said shaft.

4. The golf club swing training apparatus recited in claim 1 wherein said gap is located at a distance from said butt end of about 40% of the length of said golf club.

5. The golf club swing training apparatus recited in claim 1 wherein said slide mechanism is configured to make a discernible sound upon a lateral shift of one said shaft portion relative to the other said shaft portion.

6. The golf club swing training apparatus recited in claim 1 wherein said slide mechanism is configured to produce a tactile sensation at said butt end of said shaft upon a lateral shift of one said shaft portion relative to the other said shaft portion.

7. The golf club swing training apparatus recited in claim 1 wherein said slide mechanism comprises a pair of parallel linear glide blocks in spaced relation and a pair of fastener assemblies compressing the blocks toward one another.

8. A method of fabricating a golf club swing training apparatus; the method comprising the steps of:

a) providing a golf club having a shaft with a butt end and a head end, the head end affixed to a ball striking head;

b) cutting the shaft into two portions comprising an upper shaft portion comprising the butt end and a lower shaft portion comprising the head end;

c) removing a length of shaft from at least one of said two portions; and d) connecting said two portions to opposing connectors of a slide mechanism configured for permitting one of said two portions to translate laterally relative to the other of said two portions during a swinging of said club, said lateral translation resulting in a non-intersecting offset between the longitudinal axis of the upper end of said lower shaft portion and the longitudinal axis of the lower end of said upper shaft portion.

9. The method recited in claim 8 wherein in step d) said lateral translation is limited in distance to a maximum of 0.25 inch.

* * * * *